US006837177B2

(12) United States Patent
Tanaka

(10) Patent No.: US 6,837,177 B2
(45) Date of Patent: Jan. 4, 2005

(54) WHISTLE HAVING AIR FLOW CONVERTER

(75) Inventor: Masayuki Tanaka, Hiroshima (JP)

(73) Assignee: Molten Corporation, Hiroshima (JP)

( * ) Notice: Subject to any disclaimer, the term of this patent is extended or adjusted under 35 U.S.C. 154(b) by 0 days.

(21) Appl. No.: 09/908,562

(22) Filed: Jul. 20, 2001

(65) Prior Publication Data

US 2002/0017231 A1 Feb. 14, 2002

(30) Foreign Application Priority Data

Jul. 24, 2000 (JP) ..... 2000-221933
Jun. 8, 2001 (JP) ..... 2001-174353

(51) Int. Cl.[7] ..... G10K 5/00
(52) U.S. Cl. ..... 116/137 R; 116/140; 446/397
(58) Field of Search ..... 116/137 R, 140; 446/397, 202, 204, 206

(56) References Cited

U.S. PATENT DOCUMENTS 632,184 A * 8/1899 Johnson ..... 446/206
4,246,824 A * 1/1981 Hanson et al. ..... 84/336
4,280,299 A * 7/1981 Oka ..... 46/179
4,709,651 A * 12/1987 Lance ..... 116/137 R
4,821,670 A * 4/1989 Foxcroft et al. ..... 116/137 R
5,086,726 A * 2/1992 Sharp ..... 116/137 R
5,251,569 A * 10/1993 Seron ..... 116/137 R
5,329,872 A * 7/1994 Wright ..... 116/137 R
5,495,820 A * 3/1996 Seron ..... 116/137 R
5,546,887 A * 8/1996 Cameron ..... 116/137 R
5,564,360 A * 10/1996 Wright ..... 116/137 R
5,816,186 A * 10/1998 Shepherd ..... 116/137 R
6,109,202 A * 8/2000 Topman et al. ..... 116/137 R
2003/0116078 A1 * 6/2003 Topman et al. ..... 116/137 R

FOREIGN PATENT DOCUMENTS

GB 1020844 A2 * 7/2000
JP 8-211881 3/1996

* cited by examiner

*Primary Examiner*—Christopher W. Fulton
*Assistant Examiner*—Tania Courson
(74) *Attorney, Agent, or Firm*—Westerman, Hattori, Daniels & Adrian, LLP

(57) ABSTRACT

A whistle (1) has: a mouthpiece which includes an air inlet (4); a first and a second resonance chambers (5*a*, 5*b*) to which air is injected through the air inlet via a first and a second air passages (6*a*, 6*b*); a first and a second sound outlets (7*a*, 7*b*) in the form of openings formed between the air passages and the resonance chambers; and a first and a second air flow converters (9*a*, 9*b*) for varying the flow of air between the air passages and the sound outlets. The air flow converters (9*a*, 9*b*) are each part of the sound outlets, and have walls (10*a*, 10*b*) which are perpendicular to the air passages (6*a*, 6*b*). The air flow converters (9*a*, 9*b*) create extra higher harmonics, increase sound pressures in the resonance chambers, and shorten rising time of the whistle, so that the whistle quickly produces loud harmonious beats, which is effective to call attention of people.

8 Claims, 12 Drawing Sheets

WHISTLE HAVING AIR FLOW CONVERTER

FIELD OF THE INVENTION

The invention relates to a whistle for use in umpirage of athletic games and in security jobs including guiding and signaling to gathering people.

BACKGROUND OF THE INVENTION

Whistles are used by judges in sport tournaments for example, in signaling a start, breaks, resumption, and the end of a game, and warnings the players to follow the rules of the game. Whistles are based on a fundamental principle that an edge tone is produced by an edge inside a whistle when air is blown into the mouth (air inlet) of the whistle and that the edge tone is then amplified by resonance in a resonance chamber of the whistle.

An example of such whistles is disclosed in Japanese Patent Laid Open Publication No.8-211881. This publication teaches a whistle having a mouthpiece into which air is blown, a duct for passing the air to an edge and a resonance chamber where the blown air oscillates in resonance with an edge tone, and a sound outlet in the form of opening formed between the duct and the resonance chamber for radiating the resultant whistle sound outwardly. The whistle disclosed in this publication has a multiplicity of holes in the wall of the resonance chamber, which holes can be blocked or opened by turning a blocking member to change the tone of the whistle.

In this whistle, although the tone is alterable, its volume cannot be changed, unless a great amount of air is quickly breathed in. However, lung capacity, i.e. an amount of air that a person can breathe at a time, greatly varies from person to person, so that a person having a smaller lung capacity can produce only a small whistle sound, especially when he is not familiar with whistling, and then the sound is difficult to hear in a noisy place. If such a person could give a large blast on a whistle, he would not be able to continue blasting for a long time. It is therefore difficult for him to blow a whistle loudly.

In view of such drawbacks of conventional whistles, the invention is directed to a whistle capable of producing a louder sound containing many higher harmonics under normal breathing.

SUMMARY OF THE INVENTION

A whistle of the invention is characterized by an air flow converter for converting or varying the flow of air passed from an air passage towards the sound outlet of the whistle, thereby creating, and enhancing, extra higher harmonics.

In this arrangement, the flow of air that has passed through the air passage is varied by the air flow converter before it is discharged from the sound outlet, thereby adding many higher harmonics to the fundamental note and resulting in a penetrating sound which can be heard well even in a noisy place. It is noted that the time required for the sound to acquire its maximum amplitude is shortened by the air flow converter, so that an audible sound is generated by an ordinary breath without appreciable delay. Thus, the whistle is suitable for a judge attending a speedy game such as basketball, and for a guard guiding a crowd for example.

The air flow converter is preferably a surface of a wall (such surface hereinafter simply referred to as a wall) formed at one end of the sound outlet, adjacent to the air passage, and extending substantially perpendicularly (preferably at a right angle) to the air passage.

Alternatively, the air flow converter may be facing vertical or upright walls forming opposite sides of the sound outlet and extending substantially in parallel to the air passage.

The flow of breathed air is then varied by the air flow converter to generate higher harmonics. The resultant sound incorporating many higher harmonics has an attractive tone and becomes a penetrating sound that can be heard well in noisy places.

The air flow converter may be formed of an upright wall provided at one end of the sound outlet and adjacent to the air passage, and extending substantially perpendicularly (preferably perpendicularly) to the air passage, and facing upright walls forming opposite sides of the sound outlet to extend substantially in parallel to the air passage.

In this arrangement, the air flow converter exhibits a maximum conversion of air flow, generating a maximum number of higher harmonics.

The whistle may comprise:

- two air passages bifurcating from the air inlet;
- two resonance chambers having different volumes into which air is blown from the air passages;
- two sound outlets formed between the resonance chambers and the air passages; and
- two air flow converters formed at the respective sound outlets.

Because of this structural duality of the whistle, two sounds generated by the respective edges in combination with the resonance chambers incorporate different higher harmonics formed in the respective resonance chambers when they come out of the two sound outlets. The resultant superposed sound may beat producing a pleasant and attractive sound to the ear, which helps attract attention of people hearing the whistle.

DETAILED DESCRIPTION OF THE PREFERRED EMBODIMENT

Figure 1:
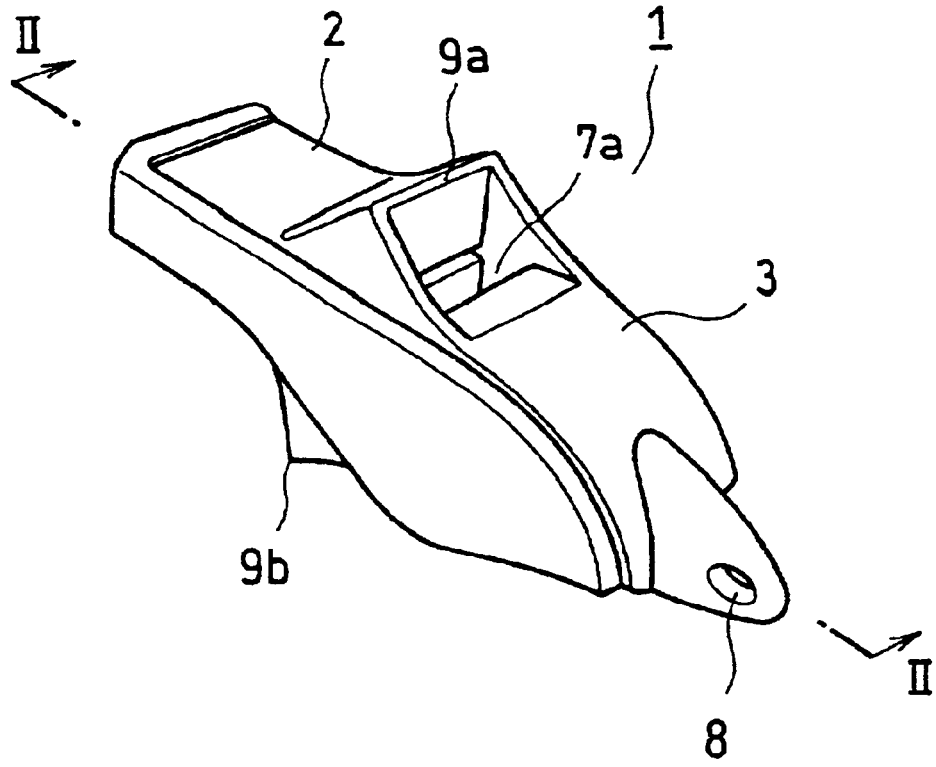
FIG. 1 is a perspective view of a whistle according to a first embodiment of the invention.
Figure 2:
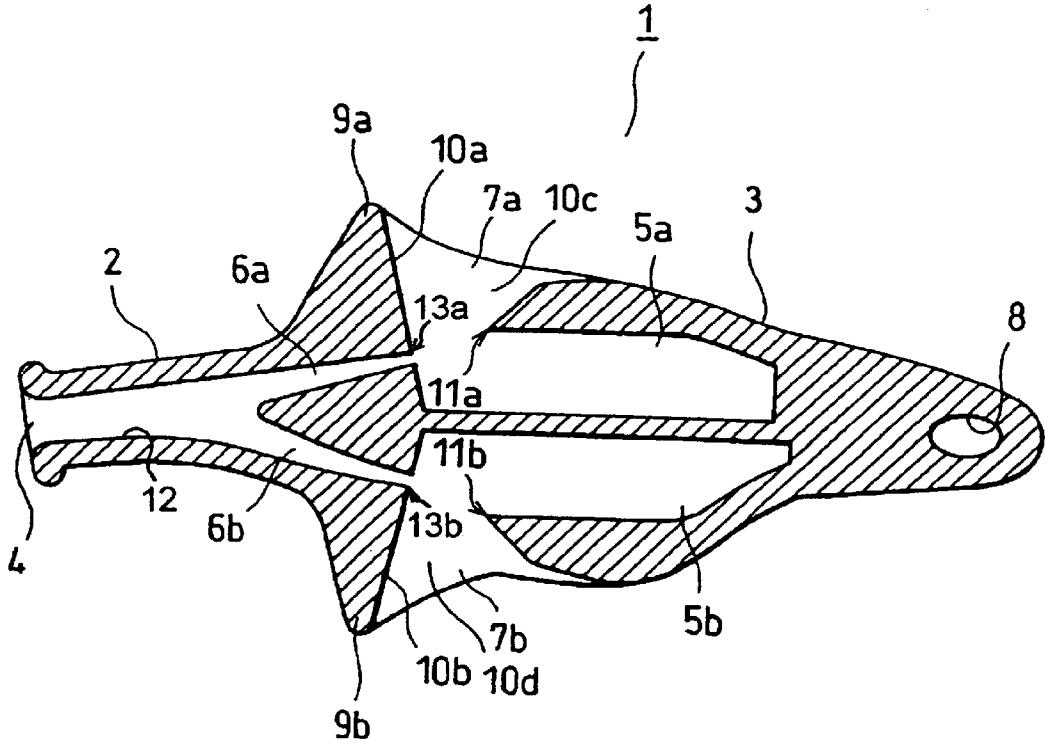
FIG. 2 is a cross sectional view of the whistle taken along line II—II of FIG. 1.

Referring now to FIGS. 1 and 2, there is shown a whistle 1 of the invention, which includes a mouthpiece 2, which has an interior mouthpiece wall 12, and a resonance section 3, both integrally formed by molding a plastic. The mouthpiece 2, adapted to be placed between the lips of a person blowing the whistle, has an elongate rectangular air inlet 4 for receiving his breath. The resonance section 3 includes a first upper and a second lower resonance chambers 5*a* and 5*b*, respectively, in the form of cylindrical cavities. The whistle has a first and a second sound outlets 7*a* and 7*b*, respectively, which are openings formed between the resonance chambers 5*a* and 5*b* and a first and a second air passages 6*a* and 6*b*, respectively, bifurcating from the air inlet 4. A hole 8 is formed at the end of the resonance section 3 for passing therethrough a hanging strap.

Wall shaped first and second air flow converters 9*a* and 9*b* each form part of a first and a second sound outlet 7*a* and 7*b*, respectively. The air flow converters 9*a* and 9*b* each have respective upright walls 10*a* and 10*b*, which meet the interior mouthpiece wall 12 at respective edges 13*a* and 13*b* and are formed at one end of the air inlet 4 of the respective sound outlets 7*a* and 7*b* and adjacent to the respective air passages 6*a* and 6*b* and at a substantially right angle (preferably exactly right angle) to the respective air passages 6*a* and 6*b*, and facing upright walls 10*c* and 10*d* forming the opposite sides of the sound outlet and extending substantially in parallel (preferably exactly parallel) to the respective air passages 6*a* and 6*b*. The air ejected from the first and the second air passages 6*a* and 6*b*, respectively, are eventually directed to the respective first and the second sound outlets 7*a* and 7*b*. The first and the second air flow converters 9*a* and 9*b*, respectively, serve to temporarily vary the paths of the air after they are discharged from the respective sound outlets.

In this manner, the walls 10*a* and 10*b* of the first and the second air flow converters 9*a* and 9*b*, respectively, are preferably formed to extend in the direction perpendicularly to the respective first and second air flow passages 6*a* and 6*b* so as to provide maximum air conversion effect, as manifested in the experiments conducted by the inventor. It should be understood, however, that substantially the same effect may be obtained by the walls 10*a* and 10*b* formed at substantially perpendicularly to the respective air passages 6*a* and 6*b*. The air conversion effect will decrease as the angle between them increases or decreases from right angle.

It has been also found in the experiments that the walls 10*a* and 10*b* preferably be flat and smooth. Otherwise, hissing noise would be generated by the walls. Edges 11*a* and 11*b* are formed at the front ends of the respective first and second sound outlet 7*a* and 7*b* (adjacent the entrance of the resonance section 3), and slightly set outward off the extensions of the first and the second air passages 6*a* and 6*b*, to generate edge tones.

Figure 3:
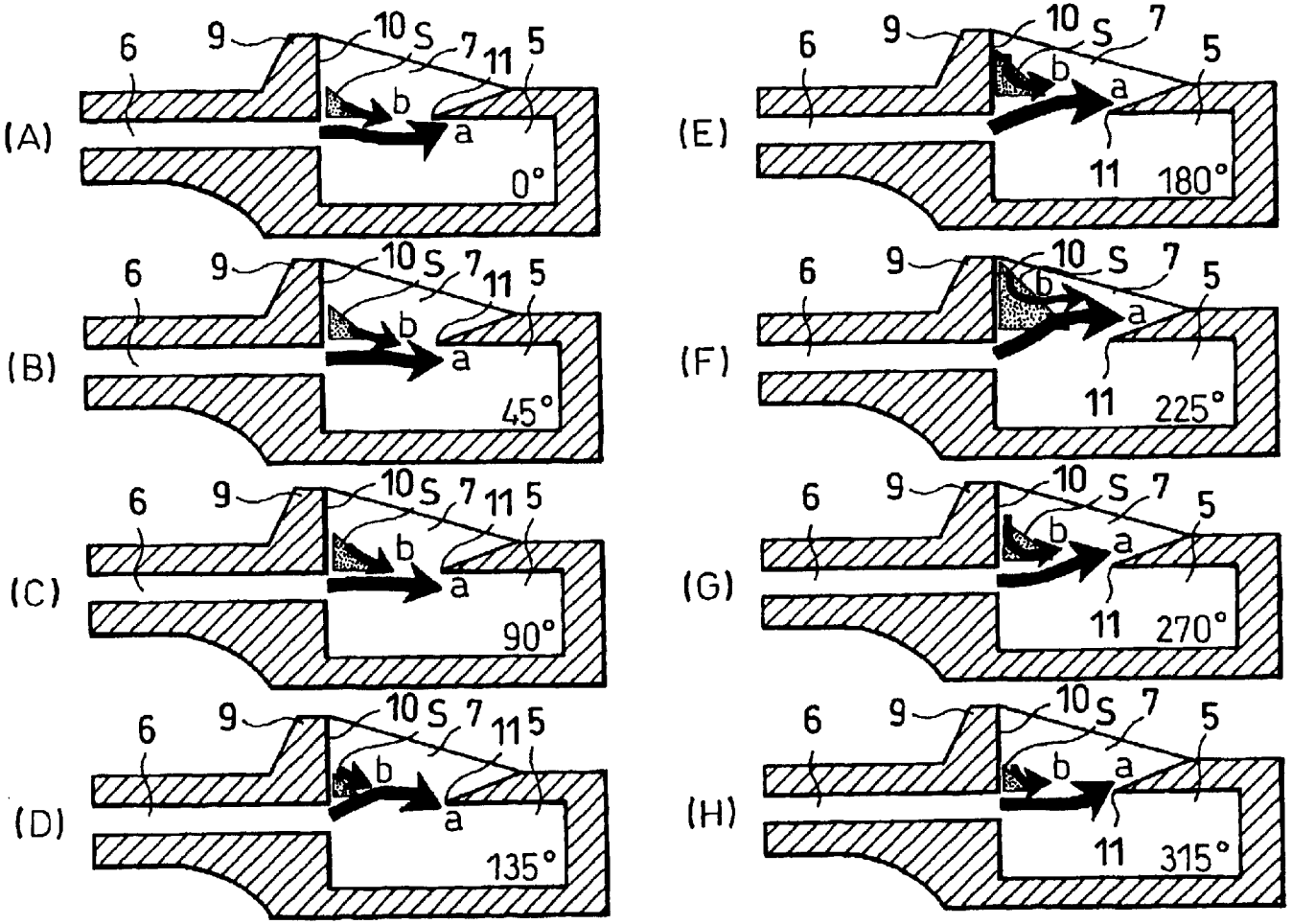
FIGS. 3(A) to (H) show the principle of a whistle generating a sound.

A fundamental principles of generating edge tones by the edge 11 will now be described below. As seen in FIG. 3, the whistle has an air passage 6, a resonance chamber 5, a sound outlet 7, and an air flow converter 9.

The air blown out of the air passage 6 travels straight ahead past the underside of the edge 11, enters the resonance chamber 5, and remain there (FIGS. 3(A)–(C)). This flow of air is shown by an arrow "a". When this air flow occurs, ambient air in a region S (negative pressure region) near the wall 10 is attracted to the flow (shown by arrow "b"). As a result, the air in the region S tends to move in the direction "b". However, the wall 10 of the air flow converter 9 prevents supplying air from the air passage and from the opposite sides of the region S, thereby creating a negative pressure in the region S.

On the other hand, the air flowing into the resonance chamber 5 develops a high pressure in the resonance chamber 5, and pushes the subsequent air, coming from the air passage 6, upward into the sound outlet 7 (D), thereby converting or forcing the air flow "a" to go away from the edge 11 to the open end of the whistle (E).

The outgoing flow of air "a" withdraws the air in the resonance chamber 5 therefrom, thereby lowering the pressure in the resonance chamber 5. Under this condition, the air flow "a" is deflected upward by the negative pressure in the region S, which in turn results in a larger negative pressure in the resonance chamber 5 (F–H) as compared with a case where no air flow converter 9 is provided. As the pressure becomes negative in the resonance chamber 5, the negative pressure attracts the flow of air "a" from the air passage 6 so that the flow of air "a" is again converted or varied into the resonance chamber 5(A).

Thus, it is seen that the negative pressure region S amplifies the oscillation of the flow of air "a" across the edge 11 (i.e. amplifying oscillatory motion of the air into and out of the resonance chamber 5), which enhances the sound pressure of the sound of the fundamental note and at the same time results in extra higher harmonics. The frequency of the whistle sound generated at the edge 11 is determined by the volume of the resonance chamber 5. In the example shown herein, the volumes of the first and the second resonance chambers 5*a* and 5*b*, respectively, are chosen such that the first resonance chamber 5*a* has a resonance frequency at 3.4 KHz while the second resonance chamber 5*b* has a resonance frequency at 3.7 KHz.

Figure 4:
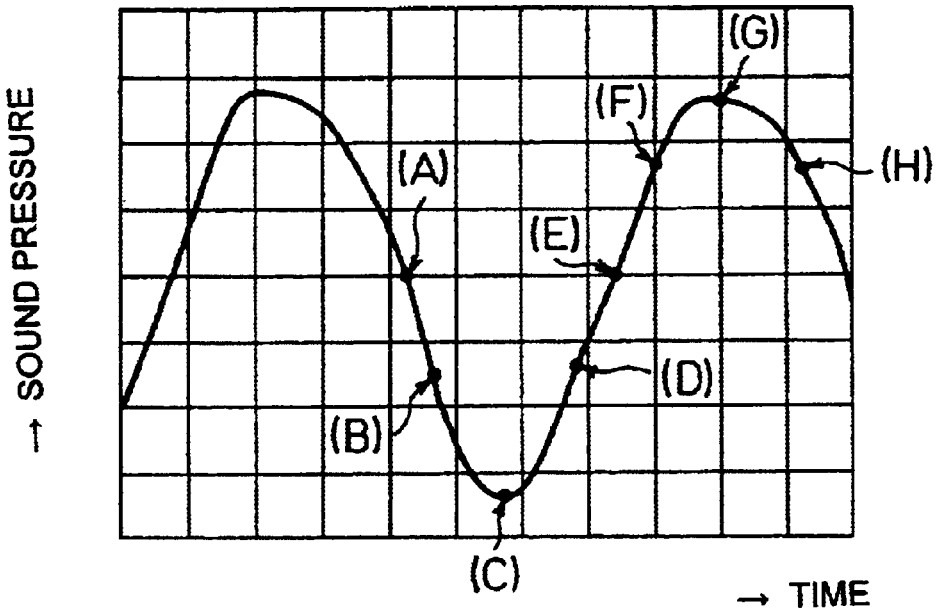
FIG. 4 shows a waveform of a whistle sound in terms of sound pressure as a function of time.
Figure 5:
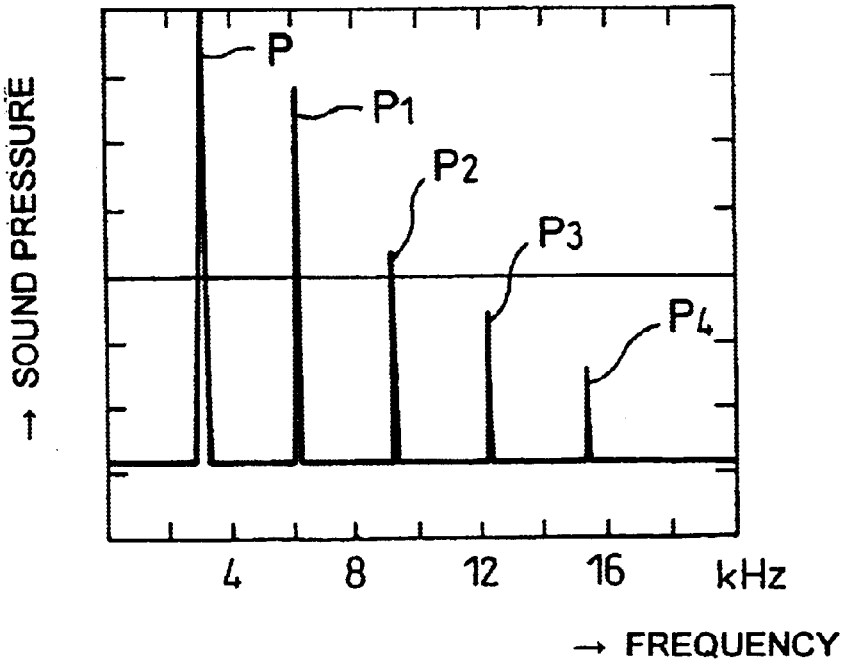
FIG. 5 shows a characteristic frequency spectrum of the whistle sound of FIG. 4, showing generation of several higher harmonics in the sound.

FIG. 4 shows a waveform, that is, a sound pressure-time curve, of a sound generated by the whistle shown in FIG. 3 tuned to a resonance frequency of 3.1 KHz. It is seen that the waveform is a slightly distorted sinusoidal curve. The deformation of the curve is due to the presence of higher harmonics in the sound. FIG. 5 shows the frequency spectrum of a whistle according to the invention having such higher harmonics. This whistle has a fundamental frequency P (about 3.1 KHz), and higher harmonics (including first harmonic P1 of about 6.2 KHz and up to the fourth harmonics P4 of about 15.5 KHz), as shown in FIG. 5. These extra higher harmonics makes the sound more comfortable, thereby making the sound more pleasant to the ear. In addition, the sound becomes more penetrating.

Figure 6:
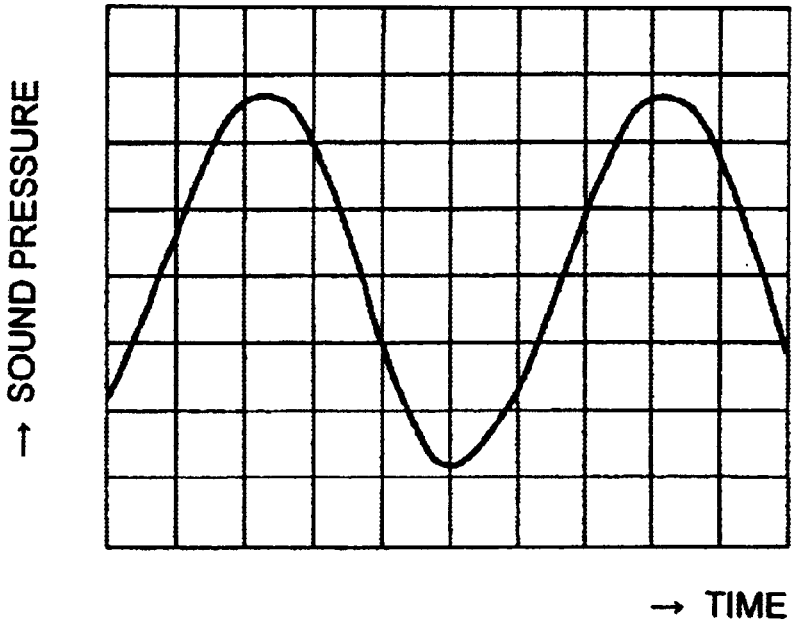
FIG. 6 PRIOR ART
FIG. 6 shows a comparative waveform of a sound generated by a conventional whistle.
Figure 7:
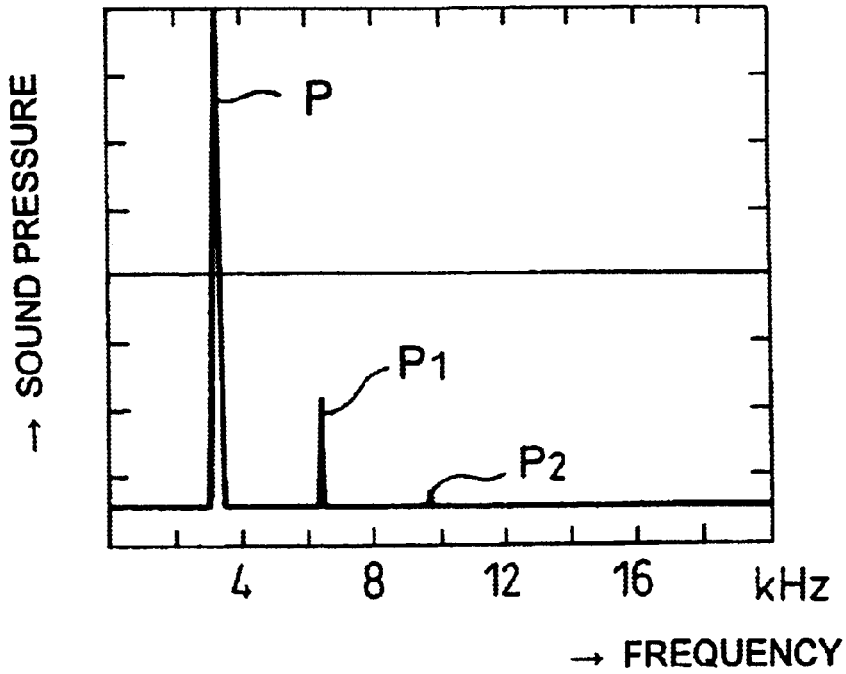
FIG. 7 PRIOR ART
FIG. 7 shows a characteristic frequency spectrum of a conventional whistle sound exhibiting several higher harmonics.

As a comparative example, the waveform and the frequency spectrum of a conventional whistle are shown in FIGS. 6 and 7. This conventional whistle has the same structure as the inventive whistle except that it is removed of the air flow converter. It is seen from FIG. 7 that the removal of the air flow converter has changed the fundamental frequency of the whistle to about 3.2 KHz. As seen from FIG. 6, the waveform is a sinusoidal curve with negligible distortion, indicating that the sound includes fewer higher harmonics. In fact, it is seen in FIG. 7 that only observable higher harmonics other than the fundamental frequency P (about 3.2 KHz) are a primary first higher harmonic P1 (about 6.4 KHz) and a minor second higher harmonic P2 (about 9.6 KHz).

Figure 8:
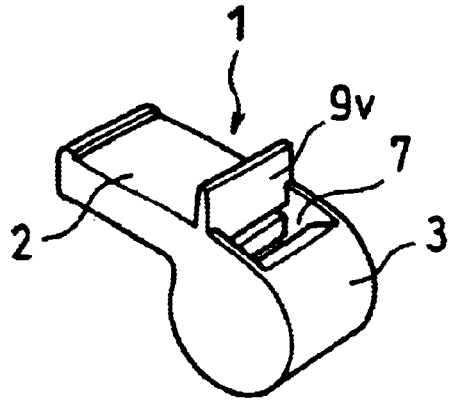
FIG. 8 is a perspective view of a whistle having an air flow converter formed at one end of the sound outlet adjacent to the air passage and at right angle to the air passage.
Figure 9:
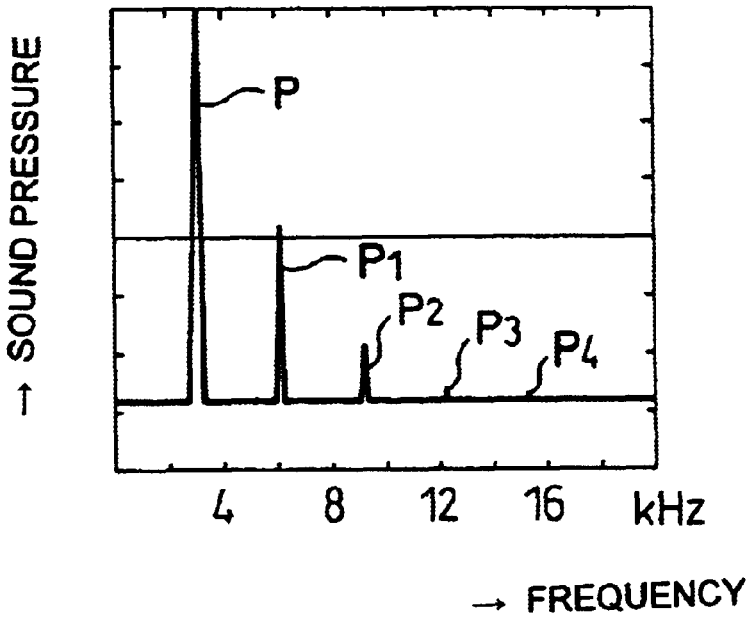
FIG. 9 is a characteristic frequency spectrum of a whistle of FIG. 8, showing four higher harmonics of the whistle.

FIG. 8 shows a whistle 1 having an air flow converter 9*v* having only an upright wall extending at a right angle to the air passage. FIG. 9 illustrates a characteristic frequency spectrum of such whistle, showing higher harmonics generated. It is seen in this figure that the air flow converter 9*v* enhances and promotes generation of higher harmonics.

Figure 10:
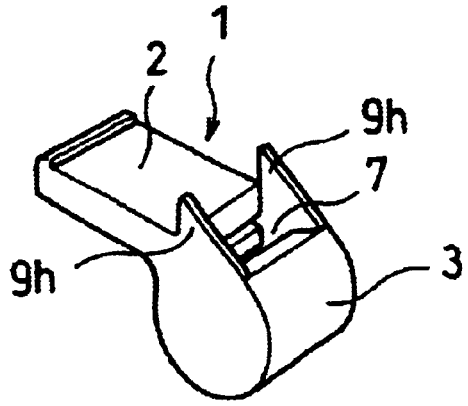
FIG. 10 shows a characteristic frequency spectrum of a whistle which has an air flow converter having upright walls forming opposite sides of the sound outlet and at right angle to the air passage.
Figure 11:
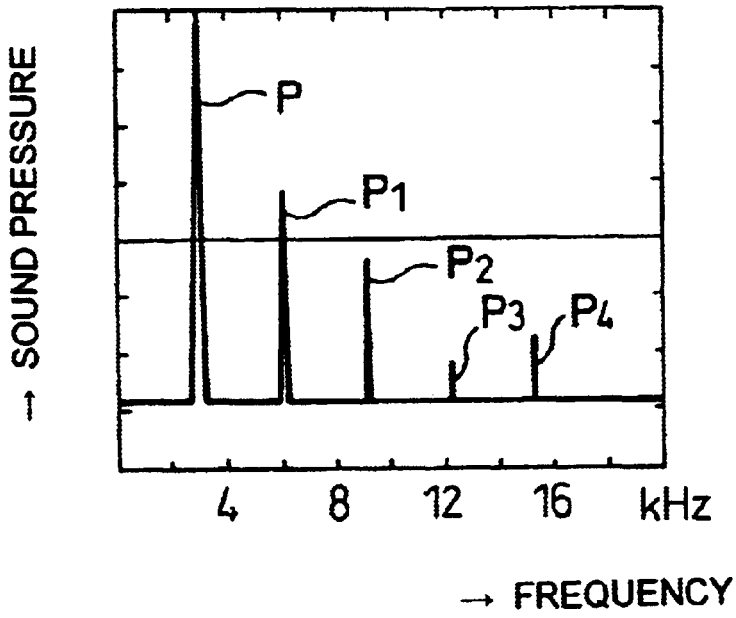
FIG. 11 shows a characteristic frequency spectrum of a whistle of FIG. 10, having four higher harmonics.

FIG. 10 shows a whistle 1 including air flow converter 9*h* having only facing upright walls forming opposite sides of the sound outlet 7 and extending in parallel to the air passage. FIG. 11 illustrates a characteristic frequency spectrum of such whistle 1, also showing higher harmonics generated. In this whistle, too, the air flow converter 9*h* enhances and promotes higher harmonics.

Figure 12:
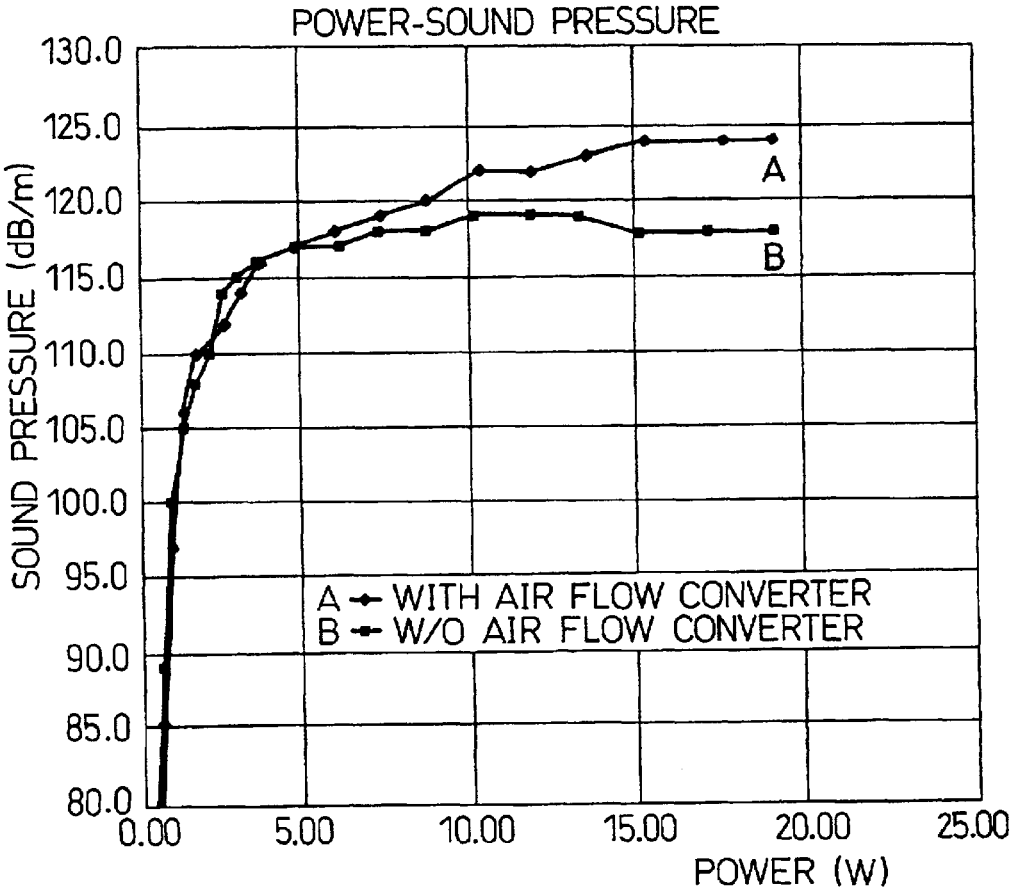
FIG. 12 shows power-sound pressure characteristics of a whistle with and without an air flow converter.
Figure 13:
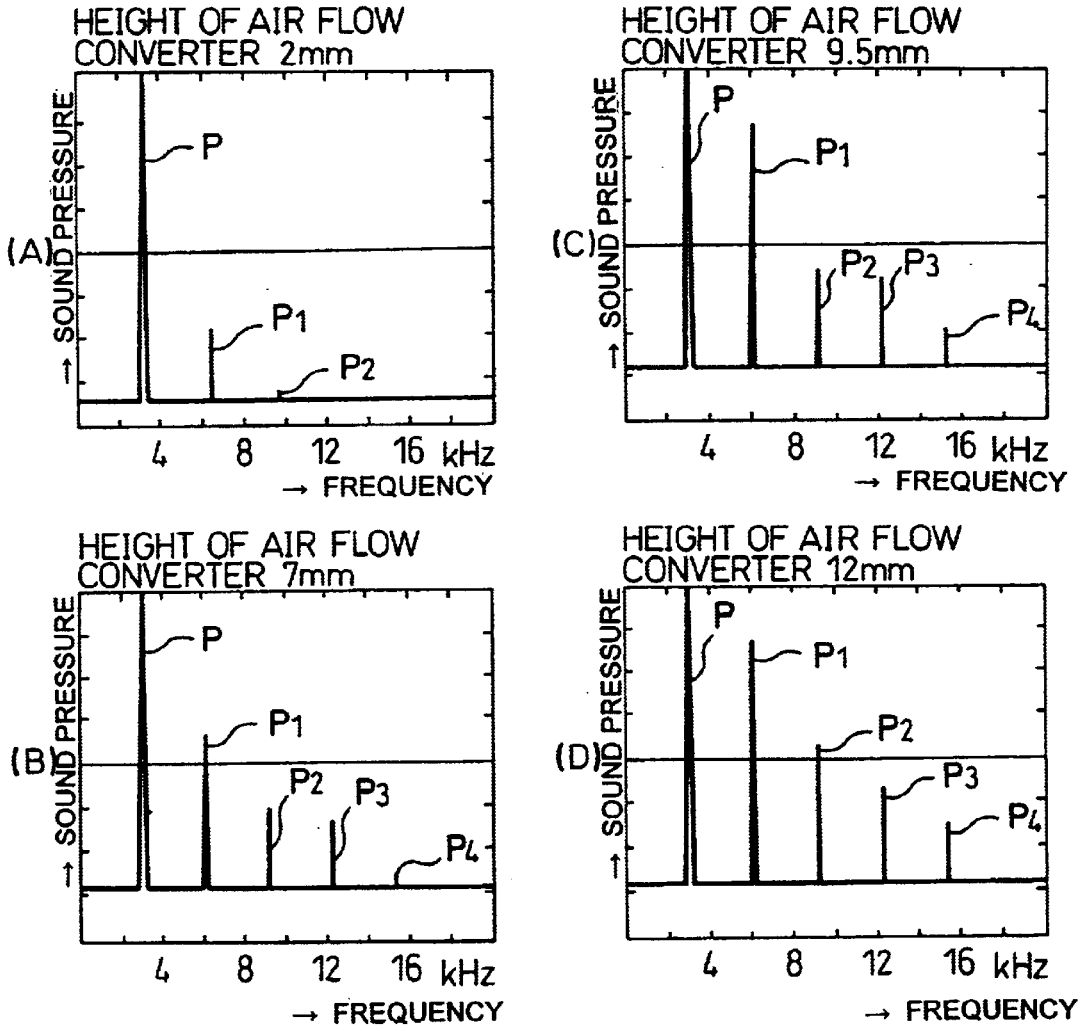
FIGS. 13(A) to (D) show characteristic frequency spectra of whistles equipped with air flow converters having different heights.

FIG. 12 shows characteristic sound pressure curves as a function of the power input to the air inlet 4 for single-tube whistles (i.e. whistles having a single resonance chamber). Curve A represents a characteristic curve of a whistle having an air flow converter and curve B of a whistle having no air flow converter. Except for the air flow converter, the two whistles have the same structure. The maximum sound pressure of the former whistle is 124 dB/m, while the maximum sound pressure of the latter is 118.3 dB/m.

The whistle 1 shown in FIG. 8, having an air flow converter 9*v* at the rear end of the sound outlet 7, has a maximum sound pressure of 120.5 dB/m. The whistle 1 shown in FIG. 10, having an air flow converter 9*h* which has facing walls only on the opposite sides of the sound outlet 7, has a maximum sound pressure of 123.3 dB/m.

Here, the term "power" is defined by the air pressure times the velocity of an air flow supplied by an air compressor, the air flow simulating a human breath. The power is measured in Watt (W). Normal breathing power of an average person ranges from about 10 to 15 Watts, which results in a difference of about 3 to 6 dB in the characteristic sound pressure between curve A and curve B. This difference can be clearly recognized when the sound is heard by an average person. In the range of power below 5 W, the breathing power is very weak, generating a very weak sound. Whistles are not normally used in this range.

FIGS. 13(A)–(D) show frequency spectra and sound pressure of higher harmonics of whistles having air flow converter 9 of FIG. 3 in the form of upright walls, which have different heights and extend at right angles to the respective air passage. The air flow converters also have side walls associated with the corresponding upright walls. FIGS. 13(A)–(D) represent cases where: (A) the height of the wall is 2 mm (which equals the thickness of the upper wall of the air passage 6, so that in this case whistle actually has no air flow converter); (B) the height of the wall is 7 mm; (C) the height of the wall is 9.5 mm; and (D) the height of the wall is 12 mm. As seen in FIG. 13, the higher the wall is, the higher becomes the sound pressure of higher harmonics. It was observed in the experiment that the sound pressure increases with the wall height up to 12 mm, but no significant sound pressure increment was observed for a higher wall. It is noted that, if the wall is higher than 12 mm, the wall blocks the nose, making breathing difficult, so that the whistle would be impractical. Thus, the maximum height of the wall of an air flow converter is about 12 mm (which is equivalent to about 10 mm as measured from the upper end of the air passage 6). Incidentally, the sound pressures and the frequencies of whistles depicted in FIGS. 13(A)–(D) are: (A) 118.3 dB/m, 3.23 KHz; (B) 120.9 dB/m, 3.11 KHz; (C) 122.2 dB/m, 3.09 KHz; and (D)) 124.0 dB/m, 3.06 KHz.

Figure 14:
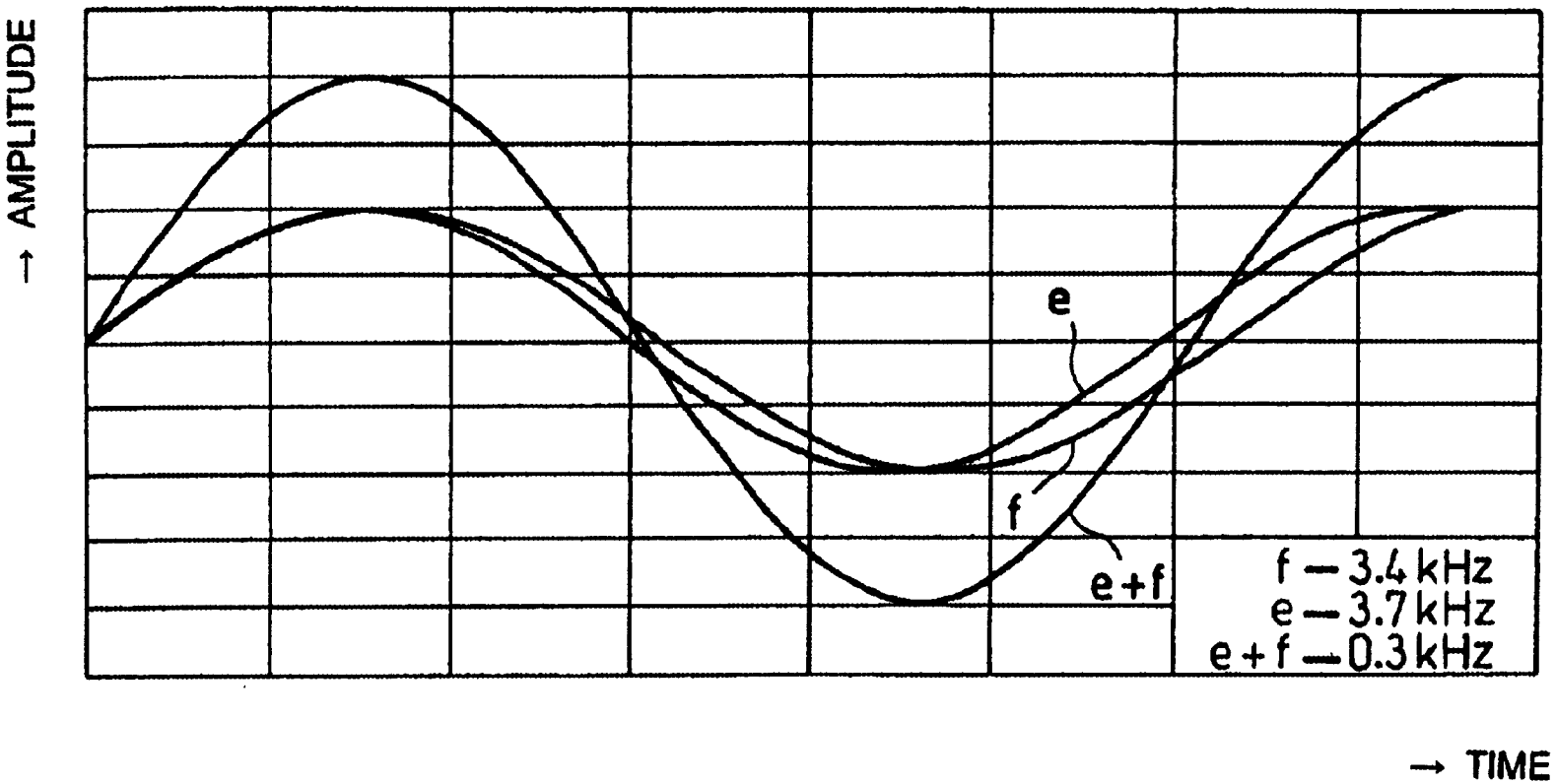
FIG. 14 shows waveforms of higher harmonics e and f generated in the first and the second resonance chambers 5*a* and 5*b*, respectively, along with a waveform of a superposed wave e+f.
Figure 15:
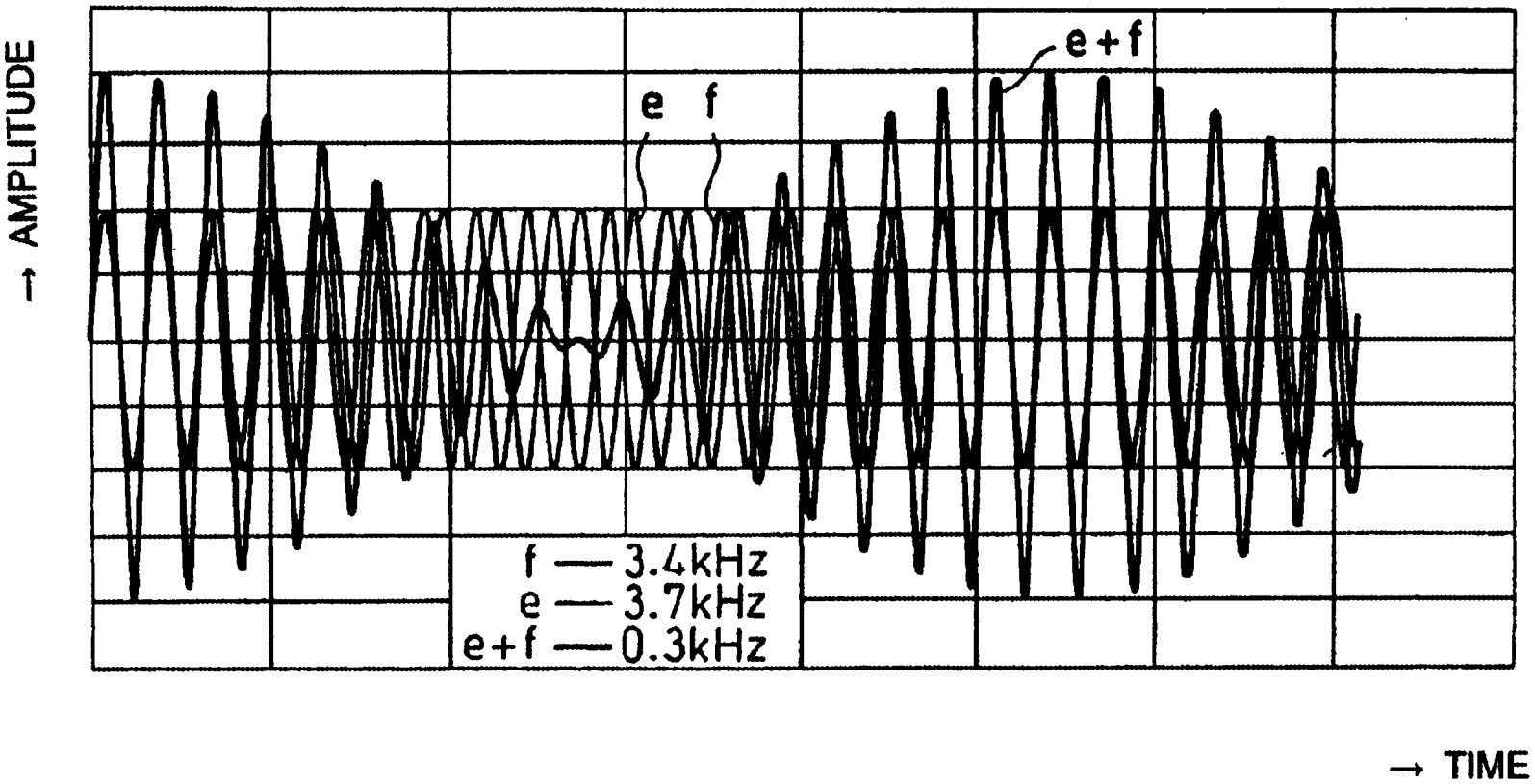
FIG. 15 shows the waveforms of FIG. 14 in a larger time scale.

FIG. 14 shows enlarged waveforms of two whistle sounds e and f generated by the first and the second resonance chambers 5*a* and 5*b*, respectively, of the whistle 1 as shown in FIGS. 1 and 2, along with a superposed wave e+f. In the example shown herein, the sounds e and f have frequencies 3.4 KHz and 3.7 KHz, respectively. FIG. 15 illustrates the same waveforms as those of FIG. 14 but shown in a larger time scale. It can be seen from the figures that the superposed sound (e+f) has a beat of 0.3 KHz, which is the difference between the original sound frequencies of the waves e and f.

As shown in FIG. 14, each of the sounds generated in the resonance chambers 5*a* and 5*b* has a constant amplitude, and is too monotonous to capture attention of people. In contrast, as shown in FIG. 15, the superposition of the two sounds e+f has a beat due to interference, which has a frequency equal to the difference between the two, and is pleasant to the ear. It is noted that when the difference in the frequency is in the range of 0.1–0.4 KHz, the two sounds are similar in quality that they make a pleasant and harmonious sound to the ear. On the other hand, if the two sounds differ beyond the range mentioned above, the beat is essentially different from the original sounds and make a displeasing sound. If the beat frequency is less than 0.1 KHz, the beat is almost negligible and the resultant sound is again monotonous.

Figure 16A:
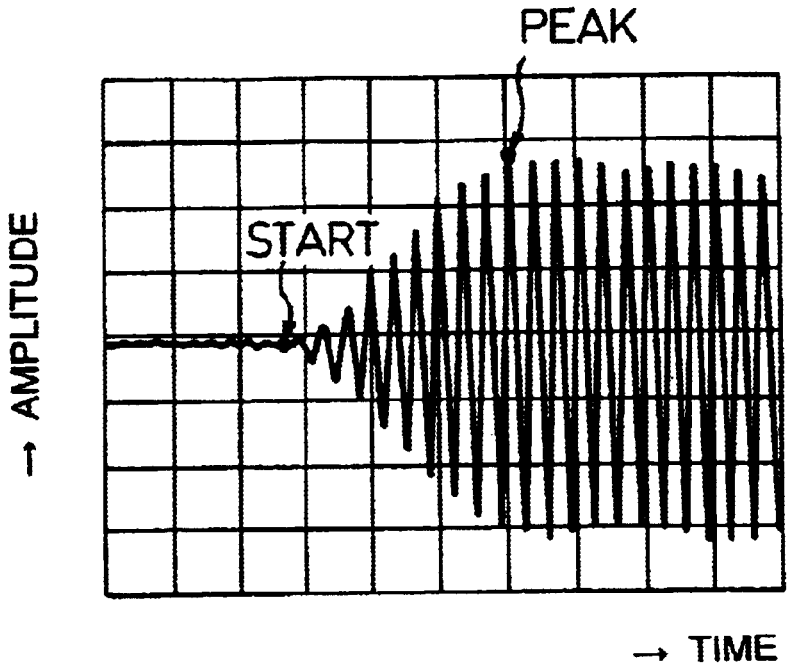
FIG. 16A shows rises of whistle sounds generated by a whistle of the invention.
Figure 16B:
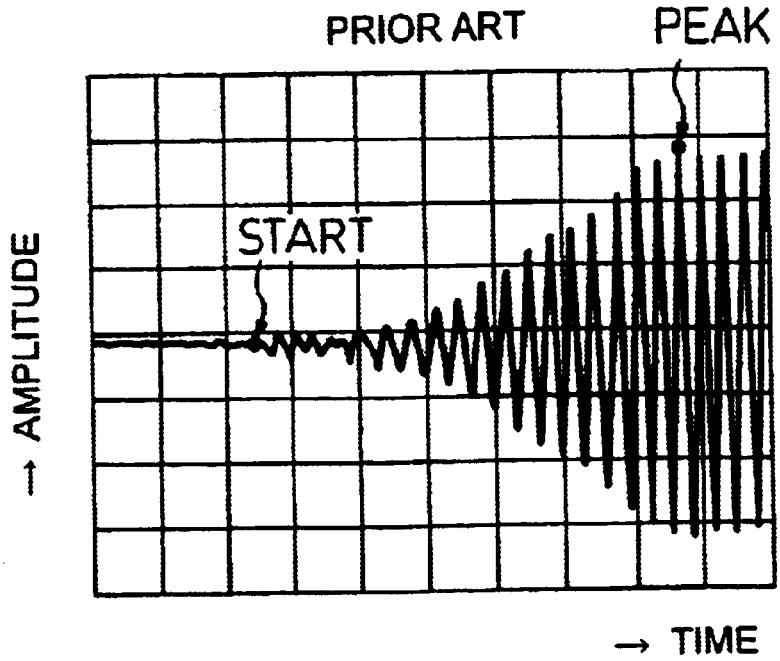
FIG.16B PRIOR ART
FIG. 16B shows rises of whistle sounds generated by a conventional whistle.

FIG. 16 illustrates the initial waveforms of sounds of two whistles, one having an air flow converter (A) and another having no air flow converter (B), showing how the sound pressure rises to its maximum value. Times for the sound pressure to rise from zero to the maximum levels (hereinafter referred to as response times) are 3.4 millisecond (for A) and 6.3 millisecond (for B), manifesting that the air flow converter shortens the response time of a whistle. The difference of 2.9 milliseconds in the response time can be well recognized by people. Incidentally, conventional whistles having therein a cork ball have response time of about 7.2 milliseconds. These whistles are too slow for use in speedy games such as basketball that they are not used in umpirage of these games. The inventive whistle has a sufficiently fast response to give players a notice of a foul play and adequate instructions with no delay.

I claim:

1. A whistle comprising an air inlet, a mouthpiece having an interior mouthpiece wall, at least one resonance chamber to which air is blown from said air inlet, at least one air passage for passing the air from said air inlet to said at least one resonance chamber, and at least one sound outlet formed between said air passage and said resonance chamber, said whistle further comprising:

at least one air flow converter, said air flow converter comprising an upright wall that forms part of said sound outlet, said upright wall meeting said interior mouthpiece wall at an edge, said air flow converter capable of varying a path of air which is blown from said sound outlet, thereby creating higher harmonic tones than the fundamental frequency tones, wherein the height of said upright wall is greater than the thickness of the interior mouthpiece wall section next to the air inlet.

2. The whistle according to claim 1, wherein said upright wall of said air flow converter is formed at one end of said sound outlet and adjacent to said air passage, and extends substantially perpendicularly to said air passage.

3. The whistle according to claim 1, wherein said air flow converter is formed of upright walls which extend on the opposite sides of said sound outlet substantially in parallel to said air passage.

4. The whistle according to claim 1, wherein said air flow converter is formed with said upright wall extending substantially perpendicularly to said air passage, and upright walls which extend on the opposite sides of said sound outlet substantially in parallel to the corresponding air passage.

5. The whistle according to claim 1, comprising:

two air passages bifurcating from said air inlet;

two resonance chambers each associated with corresponding one of said two air passages;

two sound outlets, one for each air passage, formed between said air passages and said resonance chambers; and two air flow converters, one for each sound outlet, and wherein said two resonance chambers have different volumes, and hence two different resonance frequencies.

6. The whistle according to claim 5, wherein said upright wall of each of said air flow converters is formed at one end of the corresponding sound outlet and adjacent to said air passage, and extends substantially perpendicularly to said air passage.

7. The whistle according to claim 5, wherein said air flow converters is formed of upright walls which extend substantially in parallel to the corresponding air passage.

8. The whistle according to claim 5, characterized in that said upright wall of each of said air flow converters extends substantially perpendicularly to said air passage, and upright walls which extend on the opposite sides of said sound outlet substantially in parallel to the corresponding air passage.

* * * * *